United States Patent [19]

Torassa

[11] 3,938,942

[45] Feb. 17, 1976

[54] PYROPHORIC GAS LIGHTER

[75] Inventor: Jean Francois Torassa, Nice, France

[73] Assignee: S.A.R.L. Publigam, Morteau, France

[22] Filed: Mar. 8, 1974

[21] Appl. No.: 449,376

[30] Foreign Application Priority Data

| | | |
|---|---|---|
| Mar. 9, 1973 | France | 73.10410 |
| Nov. 9, 1973 | France | 73.41898 |

[52] U.S. Cl. ..... 431/142; 431/254; 431/274; 431/277

[51] Int. Cl.[2] ..... F23Q 2/16

[58] Field of Search ..... 431/142, 143, 254, 274, 431/276, 277, 130, 131

[56] References Cited

UNITED STATES PATENTS

| | | | |
|---|---|---|---|
| 3,367,148 | 2/1968 | Bourderau | 431/276 |
| 3,523,005 | 8/1970 | Piffath et al. | 431/277 |
| 3,590,591 | 7/1971 | Genoud | 431/344 |
| 3,740,183 | 6/1973 | Piffath | 431/354 |
| 3,820,941 | 6/1974 | Piffath et al. | 431/354 |

*Primary Examiner*—Carroll B. Dority, Jr.
*Attorney, Agent, or Firm*—Young & Thompson

[57] ABSTRACT

A pyrophoric gas lighter comprises a head that slips over the hollow valve stem of a replaceable can of inflammable fluid under pressure. The valve stem is of the type that slides axially to open and close the valve. The head carries a burner that communicates with the valve stem, and a striking wheel that strikes against a flint to ignite gas issuing from the burner. Pressure on the head in the direction of the container simultaneously strikes a spark and opens the valve by depressing the valve stem that carries the lighter head. In one embodiment, the pressure of the thumb on the wheel moves the head; while in another embodiment, the pressure on the head rotates the wheel through a ratchet mechanism.

5 Claims, 6 Drawing Figures

PYROPHORIC GAS LIGHTER

The present invention relates to pyrophoric gas lighters, that is, wickless lighters that ignite a stream of gas derived from the evaporation of a combustible liquid, or an aerosol, or a compressed gas itself.

Known pyrophoric gas lighters have the disadvantage that the spark tends to precede or lag behind the release of the gas, with resultant inefficiency of operation.

The present invention accordingly has for its object the provision of a pyrophoric gas lighter in which the arrival of the gas is simultaneous with the spark.

Another object of the present invention is the provision of a pyrophoric gas lighter, which will be relatively simple and inexpensive to manufacture, easy and reliable to operate, and rugged and durable in use.

Briefly, the objects of the present invention are achieved by the provision of a pyrophoric gas lighter utilizing a container of compressed fluid, the head of the lighter which carries the wheel and flint being mounted on the head of the container of compressed gas in such a manner that by simple pressure of the thumb, the wheel rotates to produce the spark and simultaneously the valve of the container opens thus liberating the gas.

The lighter of the present invention thus comprises the combination of a pressurized container and a removable head therefor, the removable head carrying the pyrophoric flint and its positioning spring, the burner, the wheel and a gas collection chamber, the head resting freely on the valve stem of the aerosol container and sliding guidedly axially relative to the container to effect opening of the valve, which upon closing returns the lighter head to its initial position under the influence of the conventional return spring for the container valve.

According to a first embodiment of the invention, the thumb pressure which actuates the wheel and dispenses the fluid is exerted directly on the wheel.

According to the second embodiment, the thumb pressure is exerted on the lighter head whose sliding movement on the container actuates the wheel and simultaneously dispenses the fluid.

Other objects, features and advantages of the present invention will become apparent from a consideration of the following description, taken in connection with the accompanying drawings, in which.

Figure 1:
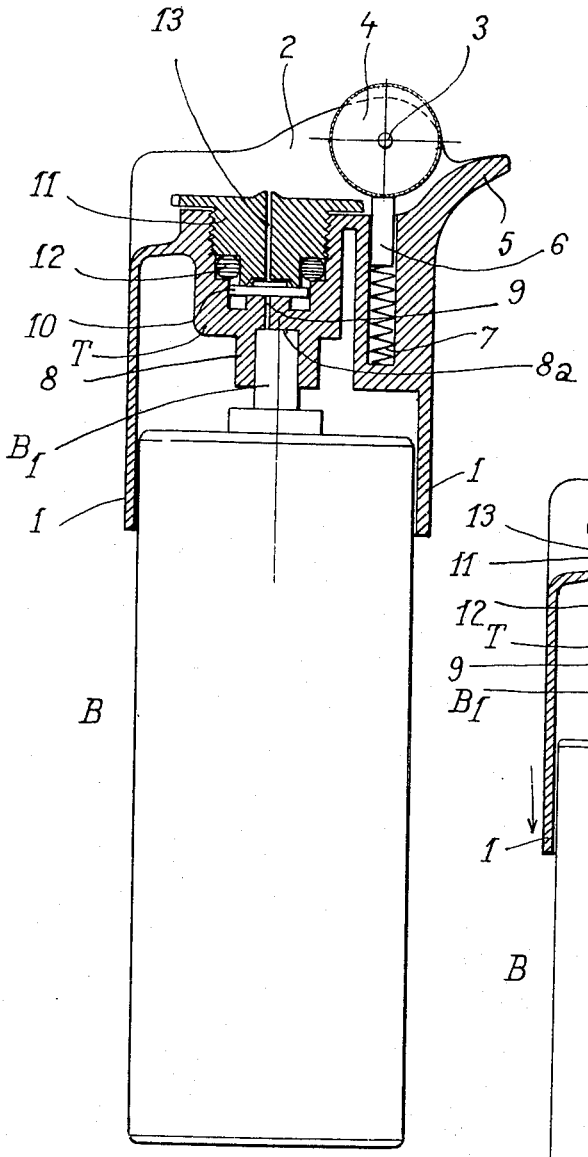
FIGS. 1 and 2 are cross-sectional views in unlighted and lighted condition, of the first embodiment of the present invention.
Figure 2:
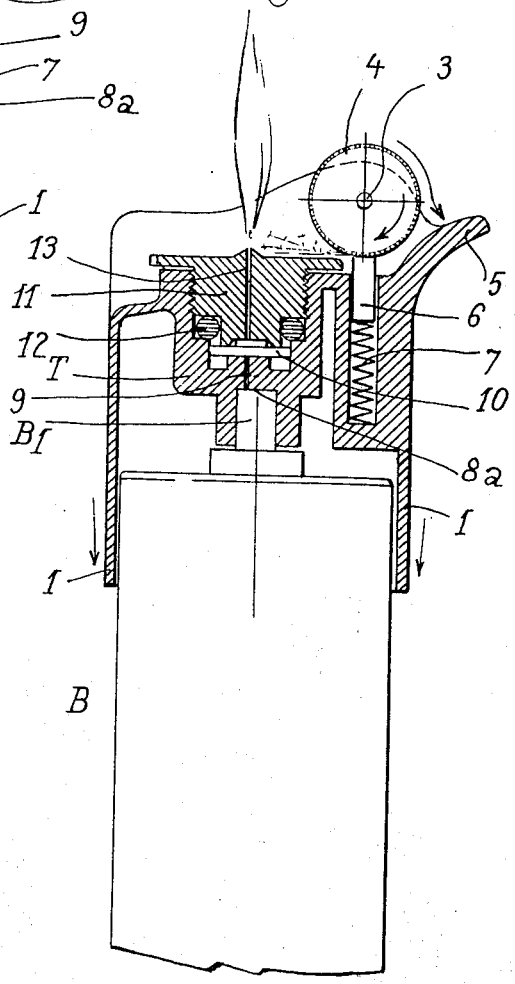

Referring now to the drawings in greater detail, and first to the embodiment of FIGs. 1 and 2, there is shown a pyrophoric gas lighter according to the present invention, comprising a conventional container B containing for example the ingredients of an aerosol comprising a pressurized gas and a quantity of combustible liquid of conventional composition dispensible in a fog or aerosol under the influence of the compressed gas. Alternatively, of course, instead of aerosol in container B, a compressed gas such as butane may be contained, or a volatile inflammable liquid. Container B has a conventional valve $B_1$ having a valve stem that slides axially of container B, in a downward direction as seen in FIG. 1, to dispense the contents of the container and in an upward direction to close the container again. The construction of container B and its valve are purely conventional and so need not be further disclosed.

The head of the lighter comprises a body T having a downwardly depending cylindrical skirt 1 which slides on the upper part of container B and which has at its upper end a pair of flanges 2 carrying between them the axle 3 of the striking wheel 4. A conventional thumbpiece 5 receives the thumb after striking movement of the wheel 4.

Body T has a conventional outwardly opening recess therein for reception of the conventional flint 6 which is urged into contact with wheel 4 by spring 7. Body T also has a downwardly depending annular collar 8 that slides on valve $B_1$, the downwardly opening recess thus provided in body T having a bottom $8_a$ by which body T presses against valve $B_1$ in an axial direction. A passage 9 eccentric to valve $B_1$ opens through bottom $8_a$ and communicates with a small collection chamber 10 between bottom $8_a$ and a burner in the form of a screw-threaded plug 11 that makes a fluidtight joint 12 with body T. Plug 11 has an axial hole 13 therethrough which opens upwardly at about the level of the bottom of wheel 4. Rotation of plug 11 permits one to regulate the height of the flame. It is to be noted that the means for regulating the height of the flame thus is positioned downstream, with respect to the direction of gas flow, from the gas valve, in contrast to known lighters in which the corresponding means is positioned upstream with respect to the valve.

From the above, the operation of the device, best shown in FIG. 2, will be evident: the user flicks the wheel 4 with his thumb in the direction of the arrow, that is, clockwise as seen in FIG. 2, after which his thumb comes to rest on the thumbpiece 5. The pressure of the thumb first on wheel 4 and then on thumbpiece 5 slides the lighter head downwardly on container B against the action of the spring of valve $B_1$ and opens valve $B_1$, so that the production of the spark and the initiation of the gas flow are substantially simultaneous. Gas flow continues as long as the thumb continues to press on thumbpiece 5. Release of pressure of the thumb on thumbpiece 5 permits the lighter head to resume its FIG. 1 position, under the spring action of valve $B_1$, whereupon valve $B_1$ closes and gas flow ceases.

As indicated above, the second embodiment of the invention is characterized in that pressure of the thumb on the lighter head simultaneously actuates the wheel and releases the gas, the thumb being out of contact with the wheel. The downward movement of the head is what actuates the wheel.

According to this second embodiment, the guide means for the lighter head during axial displacement relative to the container are also quite different from that of the first embodiment.

In this second embodiment, the guide means for the lighter head is an intermediate member of U-shaped cross section whose base rests on the head of the container and which receives the valve in its central portion, the upper ends of the legs of the U carrying two ratchets spring urged against the teeth of two ratchet wheels carried by the lighter head and secured to the axle of the wheel. In this way, the head of the lighter, resting on the valve, when pressed down moves downwardly between the two legs of the intermediate piece and thus effects the actuation of the wheel and the opening of the valve of the container and so lights the lighter. When pressure is released on the lighter head, it rises to its initial position under the influence of the return spring of the valve. At that time the flame is extinguished and the lighter is ready to be operated again by pushing again on the head of the lighter. So as not to interfere with the rotation of the wheel and so as to facilitate pressure on the lighter head, a cylindrical cap is secured to the lighter head in surrounding relationship therewith so that the intermediate piece, when pressed down, will abut at the end of its travel against a cylindrical sleeve surrounding the body of the container.

The head of the lighter comprises the burner, the wheel, the pyrophoric flint, the flint spring, and the two ratchet wheels, and is thus completely independent of the container for the combustible material.

Referring now more particularly to FIGs. 3–6, the head of the lighter in the second embodiment is comprised by a body 14 which is pressed down upon and carried by the stem of the valve $B_1$ of the container B. Body 14, which comprises the bulk of the head of the lighter, slides axially between legs 15 of an intermediate piece 16. A cylindrical cap 17 covers body 14 as well as the intermediate piece 16 and its two legs 15. Cap 17 is fixed to body 14 by means of projections 18 which are disposed in corresponding recesses in body 14, so that cap 17 and body 14 move together as a unit.

Valve $B_1$ is provided with a conduit 19 which empties into a first chamber 20 in body 14, which in turn communicates by conduit 21 with another chamber 22 whose volume is regulable by screwing the burner 23 in or out. An O-ring 12 seals between burner 23 and body 14. Burner 23 contains an axial conduit 24 which communicates between chamber 22 and the inside of a tube 25 which has a lateral opening 26 that permits the passage of sparks struck by wheel 27 against flint 28. A torsion spring 29 maintains flint 28 in contact with wheel 27, the flint 28 riding in a passageway 30 which opens downwardly to permit replacement of the flint when the leg 29A of the spring 29 that bears against the flint is moved out of passage 30 (see also FIG. 6).

Figure 6:
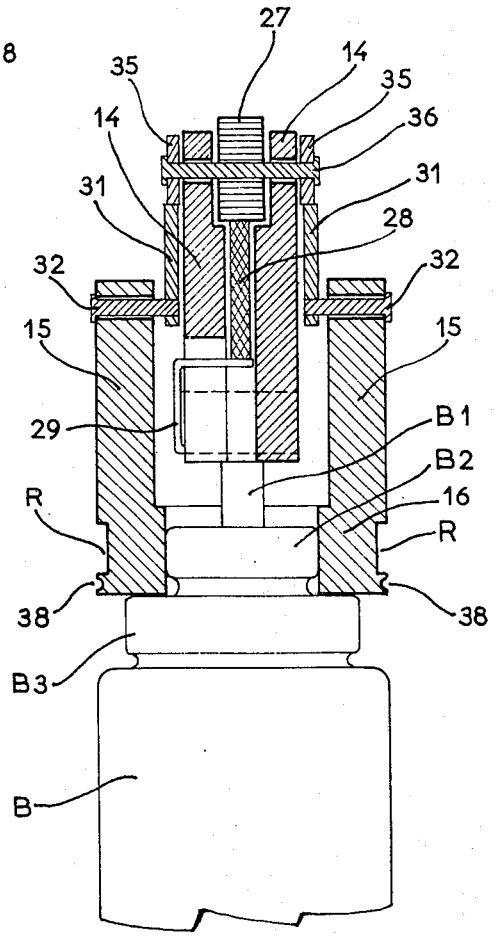
FIG. 6 is a cross-sectional view taken at right angles to FIG. 5.

As best seen in FIG. 6, on each leg 16 is pivotally mounted a ratchet 31 on a shaft 32 (see FIGS. 5 and 6); and the leg 33 of a torsion spring 34 urges each ratchet 31 against each of a pair of ratchet wheels 35 mounted on a common shaft 36 that is fixedly secured to wheel 27.

The cap 17 has an opening therethrough, through which the tube 25 projects. Intermediate piece 16 surrounds the head B2 of the container and rests on shoulder B3 of the container and so the lighter head is quite stable on the container B. Intermediate piece 16 has a wide groove R about its lower end, which permits the in-turned flange at the lower end of cap 17 to ride therein when cap 17 moves relative to the lighter. A cylindrical sleeve 37 surrounds the container and has at its upper end an in-turned flange which is disposed in a groove 38 that surrounds the lower end of intermediate piece 16. Between them, the cap 17 and the sleeve 37 cover most of the lighter; and in the illuminated position of the lighter (FIG. 4) cover all of the lighter. Cap 17 and sleeve 37 may be made of a resilient plastic material for ease of assembly.

Figure 4:
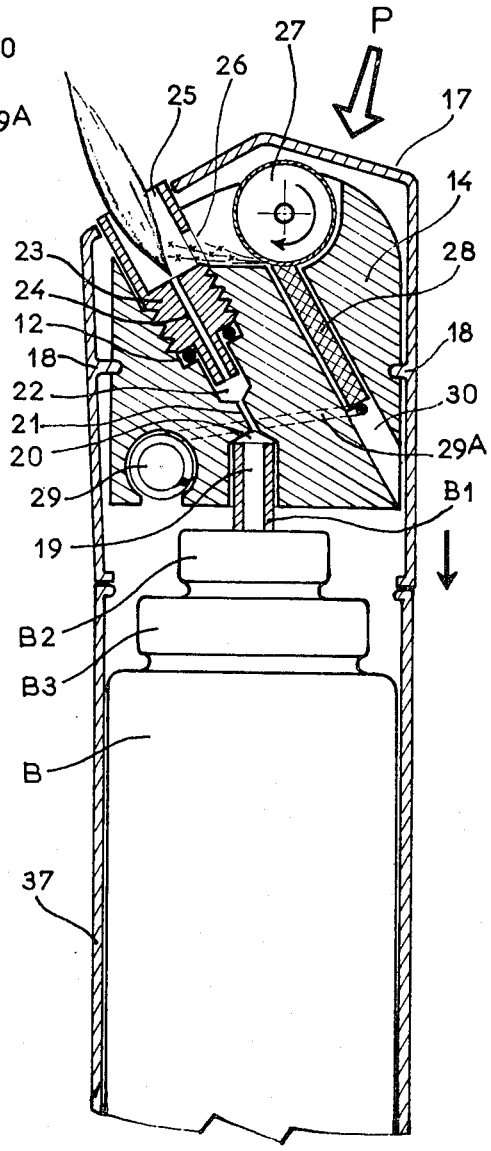
Figure 5:
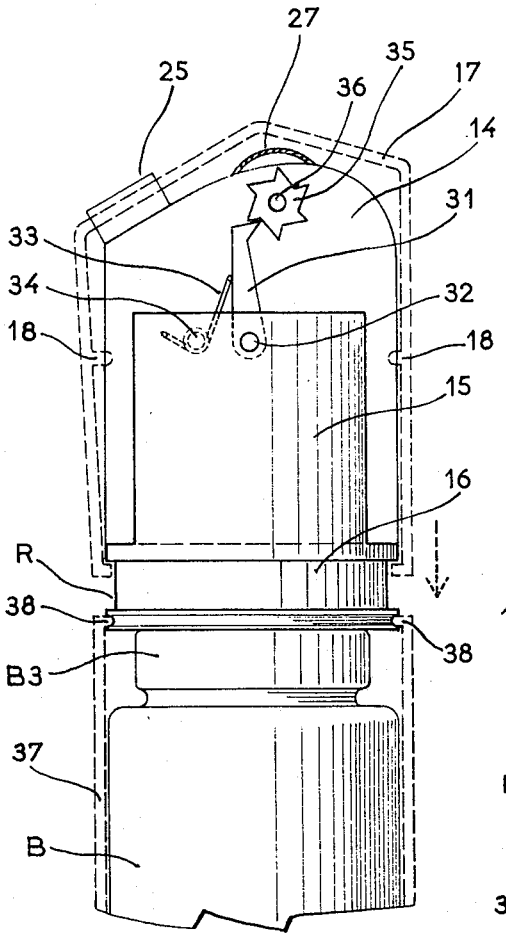
FIG. 5 is an elevational view of the head of a lighter according to the embodiment of FIGS. 3 and 4, with the protective cap removed.

As will be evident, when one presses down on the cap 17 in the direction of the arrow P shown in FIG. 4, the head 14 will be moved downwardly and the valve stem of the pressurized container will be moved down to open the valve and permit discharge of inflammable fluid. At the same time, the intermediate piece 16 with its legs 15 will be held against lowering movement by the container itself, as seen in FIG. 6, with the result that the ratchets 31 will cause the ratchet wheels 35 to turn, and so the wheel 27 will be turned against the flint 28 to strike a spark to ignite the inflammable fluid that escapes through conduit 24 into tube 25.

Figure 3:
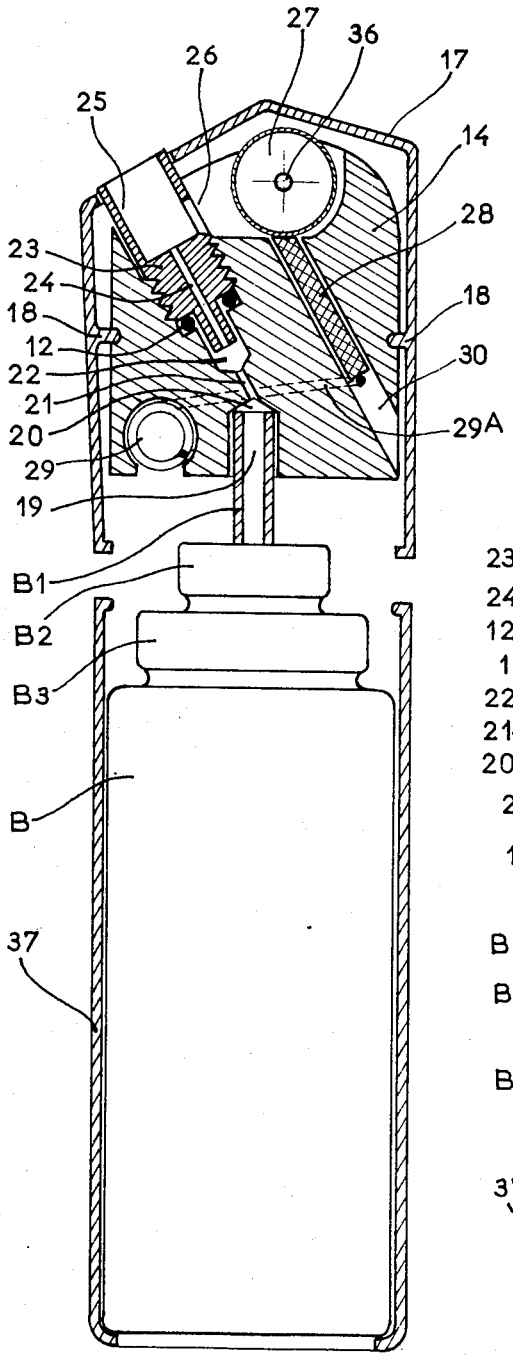
FIGS. 3 and 4 are views corresponding to FIGS. 1 and 2, respectively, but showing a second embodiment of the invention.

When the pressure of the thumb or finger is released from the cap 17, the parts resume their FIG. 3 position; the valve $B_1$ is closed and the flow of inflammable fluid stops, and the lighter is extinguished. During this return movement, the ratchet wheel 35 rides over the ratchet 31 against the action of spring 34 to return to the FIG. 5 position.

The invention thus permits the production of a very simple pyrophoric lighter, at low cost, which at the time will be automatic in its operation. Moreover, the assembly of the lighter to a metal pressurized container of inflammable fluid is very rapid because it is necessary only to slide the lighter head onto the operating stem of the valve of the pressurized container. It is especially to be noted that the lighter head is a unitary assembly whose weight can be very small and whose size can be quite compact, thanks to the special arrangement of the burner, the wheel, and the flint spring urged against the wheel. The miniaturization of the lighter head can thus permit one to obtain an automatic lighter which will nevertheless be no heavier than a lighter which is not correspondingly automatic.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described my invention, I claim:

1. A pyrophoric lighter comprising a head, means for mounting said head freely on the spring-urged stem of the valve of a can of pressurized inflammable fluid, said head having a passage therethrough for said inflammable fluid from said valve stem to a point outside said head, a striking wheel for rotation against a flint carried by the lighter head to direct sparks toward said point to ignite fluid passing through said passageway to said point, whereby pressure on said head in the direction of a said container depresses the said valve stem to initiate flow of gas through said passageway, the release of said pressure permitting said head to move away from the container under the urging of the spring of said valve stem thereby to discontinue the flow of said fluid, and guide means for guiding said head on said container, said guide means comprising an intermediate piece comprised by a pair of legs that rest on a said container and that support between them means for rotating said wheel upon movement of said head toward said container.

2. A lighter as claimed in claim 1, and two ratchet wheels fixed to the wheel, each said leg pivotally carrying a ratchet engageable with a said ratchet wheel whereby movement of the head relative to the legs turns said ratchet wheels to turn the first-mentioned wheel.

3. A lighter as claimed in claim 1, and a cap covering said head and intermediate piece.

4. A lighter as claimed in claim 3, said intermediate piece having a wide groove therein in which a radially inwardly extending flange on the end of said cap is disposed.

5. A lighter as claimed in claim 1, said intermediate piece having an outwardly opening groove about its lower edge, and a cylindrical sleeve for surrounding a said container, said sleeve having a radially inwardly extending flange about its upper end, said flange being removably disposed in said groove.

* * * * *